United States Patent [19]
Carpenter et al.
[11] 4,147,904
[45] Apr. 3, 1979

[54] MICROPHONE WITH CHANNEL SELECTOR AND PUSH-TO-TALK BUTTON INTERLOCK

[75] Inventors: Michael P. Carpenter, Robbinsdale; Paul M. D'Amico, Bloomington, both of Minn.

[73] Assignee: Telex Communications, Inc., Minneapolis, Minn.

[21] Appl. No.: 883,372

[22] Filed: Mar. 6, 1978

[51] Int. Cl.[2] ..... H04R 1/02
[52] U.S. Cl. ..... 179/178; 325/15
[58] Field of Search ..... 179/178, 179; 325/15, 325/16, 111, 119

[56] References Cited

U.S. PATENT DOCUMENTS 4,032,844 6/1977 Imazeki ..... 325/15

*Primary Examiner*—Thomas W. Brown
*Attorney, Agent, or Firm*—Warren A. Sturm; Hugh D. Jaeger

[57] ABSTRACT

A microphone having a push to talk switch button extending through a slot in one side of the microphone and a channel selector switch knob extending through at least one other slot in the microphone. An interlocking structure, having at least one finger extending from an extension member on the push to talk switch button, engages and locks with a plurality of alternating teeth and spaces on the channel selector switch knob. During a transmit mode of operation, the push to talk switch, having the interlocking finger, engages in at least one space between two of the teeth of the channel selector switch knob to prevent rotary movement of the channel selector switch knob and switching of channels during the transmit mode of operation of the microphone.

10 Claims, 4 Drawing Figures

MICROPHONE WITH CHANNEL SELECTOR AND PUSH-TO-TALK BUTTON INTERLOCK

BACKGROUND OF THE INVENTION

1. Field of the Invention

The present invention relates generally to improvements in a microphone for two-way radio communications equipment, and more particularly, pertains to a new and improved push to talk microphone having interlocking engagement structure between the push to talk switch button and the channel selector switch knob and switching of channels during the transmit mode of operation.

2. Description of the Prior Art

One of the most critical problems confronting the developers of new push to talk microphones for two-way radio communications equipment has been to prevent channel switching during the transmit mode of operation, especially in the Citizens Radio Service as designated by the Federal Communications Commission and as also known as CB Radio, CB Band, etc. This problem is overcome by the present invention.

It is now becoming a general practice in the field of two-way radio communications equipment to utilize microphones with channel switching mechanisms on the microphones for the operator's convenience. The need in the industry for a microphone having all operator controls and functions on the microphone permitting remote operation of the two-way radio communications equipment has been necessitated by an increasing theft rate of two-way radio communications equipment, specifically CB radios. Some microphones presently manufactured have some of the radio functions such as the on-off volume control, the squelch control, the channel selector switch knob, a channel indicating device such as a light emitting diode readout display, etc., located on the microphone which is provided with a plug on the end of the microphone cord to mate with the two-way radio communications equipment. This permits the operator to unplug the microphone from the communications equipment or a remote control unit connected to the communications equipment in the event the communications equipment is located in a remote place, such as in a trunk of a vehicle.

The prior art push to talk microphones have permitted the switching of channels during the transmit mode of operation which sometimes resulted in transmission on frequencies other than those designated as authorized channels by the Federal Communication Commission due to the design and inherent electrical operations of the two-way radio communications equipment. Specifically, rotating the channel selector switch knob resulted in transmitting on channels in between designated channels or transmitting on channels out of band.

This invention provides an interlocking structure for the push to talk microphone to prevent switching between channels during the transmit mode of operation of the microphone.

SUMMARY OF THE INVENTION

The present invention obviates the foregoing disadvantages of the prior art by providing a push to talk microphone having interlocking structure between the push to talk switch button and the channel selector switch knob so that the switching of channels during the transmit mode of operation is prevented by the interlocking structure.

According to a preferred embodiment of the present invention, there is provided the combination in a communications microphone comprising a hollow housing, a grill positioned in the housing and a microphone positioned adjacent the grill, a spring actuated push to talk switch button pivotally mounted in the housing and having a portion extending through a slot in the housing, a push to talk spring actuated plunger switch mounted in the housing and having a plunger engaging against a portion of the push to talk switch button, a channel selector switch knob mounted in the housing and having a portion extending through at least a slot in the housing, and an interlocking structure operably engagable between the push to talk switch button and the channel selector knob whereby the interlocking structure lockably engages the channel selector switch knob during the transmit mode of operation of the microphone when the push to talk switch button means is depressed thereby preventing the switching of channels during the transmit mode of operation.

A significant aspect and feature of the present invention is a push to talk communications microphone having interlocking structure which prevents the changing of channels during depression of the push to talk switch. This prevents the two-way radio communications equipment from being operated on channels in between those channels designated as frequencies of operation or outside of those channels designated as frequencies of operation by the Federal Communications Commission.

Having briefly described an embodiment of the present invention, it is a principal object hereof to provide a new and improved microphone.

An object of the present invention is to provide a push to talk communications microphone having a push to talk switch button, a channel selector switch knob, a squelch control, an on-off volume control, and a light emitting diode readout display indicating the channel of operation.

Another object of the present invention is to provide a push to talk communications microphone with interlocking structure so that it is not possible to change the channel of operation during the transmit mode of operation when depressing the push to talk switch button. The interlocking structure prevents the changing of channels and prevents the transmission of frequencies between channels or transmission on channels out of band as designated by the Federal Communications Commission.

BRIEF DESCRIPTION OF THE DRAWINGS

Other objects and many of the attendant advantages of this invention will be readily appreciated as the same is better understood by reference to the following detailed description when considered in connection with the accompanying drawing, in which like reference numerals designate like parts throughout the Figures thereof and wherein.

DESCRIPTION OF THE PREFERRED EMBODIMENT

Figure 1:
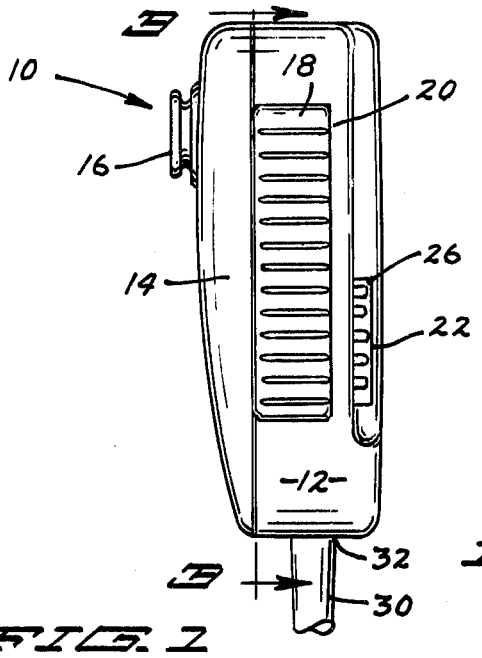
FIG. 1 illustrates a side view of a preferred embodiment of the invention, a microphone.
Figure 2:
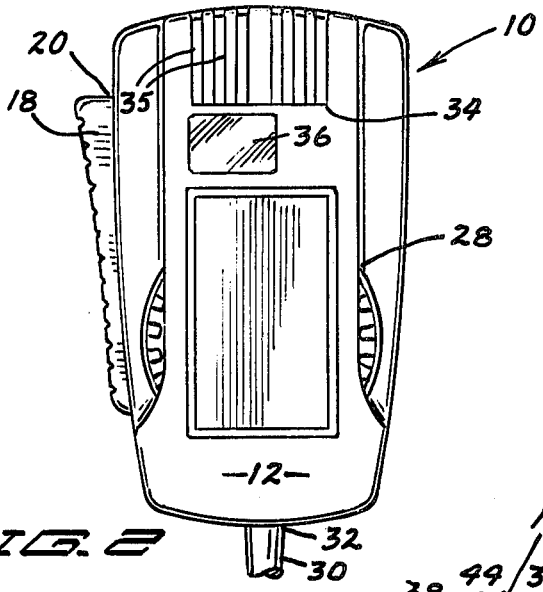
FIG. 2 illustrates a front view of the invention.
Figure 3:
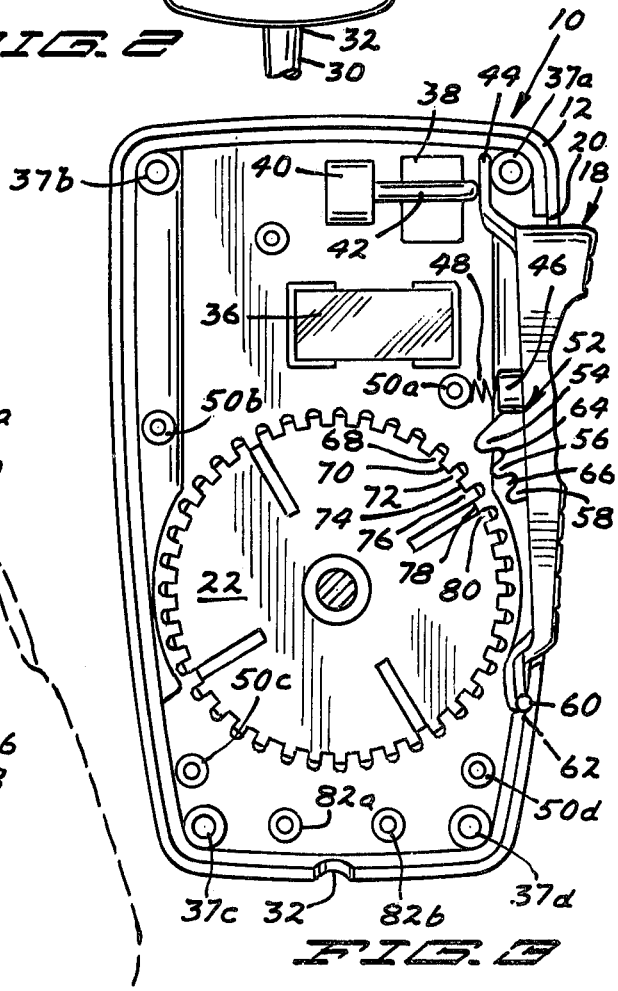
FIG. 3 illustrates a section of the invention taken on the line 3—3 of FIG. 1 looking in the direction of the arrows; and, FIG. 4 illustrates a section of the device taken on line 3—3 of FIG. 1 looking in the direction of the arrows with a push to talk switch depressed by the thumb of an operator's hand.
Figure 4:
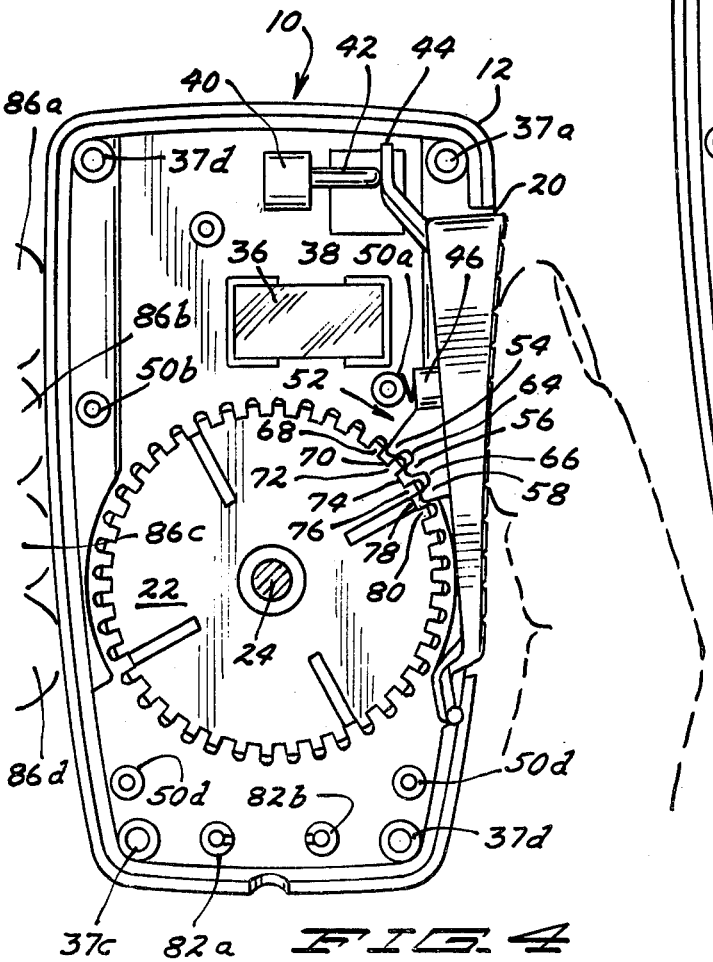

FIG. 1 illustrates a left side view of a preferred embodiment of the invention, a push to talk communications microphone 10. A front housing 12 and a back housing 14 engage together forming the microphone 10 and are held in engagement by fasteners such as self tapping Phillips head screws. A microphone hanger button 16 secures to the back housing 14 so that the microphone 10 can be hung on a microphone hanger. A push to talk switch button 18 extends through a slot 20 in the left side of the front housing 12. A channel selector switch knob 22 rotates on a post 24 as illustrated in FIGS. 2–4 and extends outward through a slot 26 on the left side of the front housing 12 and through a slot 28 on the right side of the front housing 12. A microphone cord 30 extends outward through a hole 32 in the microphone 10.

FIG. 2 illustrates a front view of the microphone 10 showing the front housing 12, the push to talk switch button 18 extending through the slot 20, the channel selector switch knob 22 rotating on the post 24 extending through the slots 26 and 28 in the front housing 12, and the microphone cord 30 extending through the hole 32. A microphone grill 34 having a plurality of slits 35 extending through the front housing 12 is positioned in the upper portion of the front housing 12 of the microphone 10. A light emitting diode channel readout window 36 is positioned below the microphone grill in the front housing of the microphone 10.

FIG. 3 illustrates a section of the invention taken on the line 3—3 of FIG. 1 looking in the directions of the arrows showing the microphone 10, the front housing 12, the push to talk switch button 18 extending through the slot 20, the channel selector switch knob 22 rotatably mounted on the post 24 and extending outward through slots 26 and 28, the semicircular hole 32 for the microphone cord 30 with the other semicircular hole located in the back housing 14 and which is not shown in the drawing, and the light emitting diode channel readout window 36. Screw posts **37*a*–37*d* accept threaded screws securing the back housing 14 to the front housing 12 of the microphone 10. A microphone 38 is affixed with any suitable type of adhesive such as silicon or epoxy cement for way of example and purposes of illustration, in the upper right front corner of the plurality of slits 35 of the microphone grill 34 in the upper right hand inside portion of the front housing 12 as shown in the figure. A normally open switch 40 having a spring actuated plunger 42 mounts in the upper left hand inside portion of the front housing 12 with the plunger 42 extending above and beyond the microphone 38. The push to talk switch button 18 consists of a plunger actuating member 44, a spring boss 46 which accommodates a spring 48 that compresses between a post 50*a* and the spring boss 46, an extension member 52 having an upper interlocking finger 54, a middle interlocking finger 56 and a lower interlocking finger 58, and a post 60 which pivots in a hole 62 of the front housing 12. One indentation 64 is positioned between the interlocking fingers 54 and 56 on the extension member 52 of the push to talk switch button 18 and likewise, another indentation 66 is positioned between the interlocking fingers 56 and 58. The channel selector switch knob 22 has forty alternating teeth, one of which is designated as tooth 68 with forty alternating spaces, one of which is designated as space 70 which correspond to the forty channels of the Citizens Radio Service under Part 95 of the Federal Communications Commission's Rules and Regulations. This number of alternating teeth and spaces is not to be construed as limiting in any way, and is for purposes of illustration and way of example only. Posts 50*a*–50*d* accommodate a printed circuit board not illustrated for the purpose of clarity in the drawings which contains the light emitting diodes indicating the channel of operation, a rotary channel switch which connects to the channel selector switch knob 22 having an equal number of detent positions corresponding to an equal number of channels of operation, and other associated transmit-receive circuitry. Posts 82*a* and 82*b* accept a microphone cord clamp, not illustrated for the purpose of clarity in the drawings, which secures the microphone cord 30 to the microphone 10 through the force of friction of the clamp acting against the microphone cord 30 which is held by the posts 82*a* and 82*b***.

FIG. 4 illustrates a section of the invention taken on the line 3—3 of FIG. 1 looking in the direction of the arrows with the push to talk switch button 18 of the microphone 10 depressed by a thumb **84*a* of an operator's hand resulting in locking engagement of the interlocking fingers 54, 56 and 58 of the extension member 52 with spaces 70, 74 and 78 alternating with the teeth 68, 72 and 76 of the channel selector switch knob 22. Fingers 86*a*–86*d* of the operator's hand provide further support for the microphone 10**. All other elements correspond to the elements recited in the preceding paragraphs.

Preferred Mode of Operation

Microphone 10 is designed for use with two-way radio communications equipment having a push to talk feature whereby depressing the push to talk switch of the communications microphone actuates the two-way radio communications equipment into the transmit mode of operation.

Microphone 10 connects to two-way radio communications equipment such as a CB radio or any other type of two-way communications radio such as a mobile radio telephone, ship to shore radio, aircraft radio, police radio, taxi radio, amateur radio, etc., with the microphone cord 30. Microphone cord 30 contains the electrical circuits for the push to talk switch circuit, the microphone circuit, the channel selector switching circuit, the light emitting diode circuit, the squelch circuit, the on-off volume control circuit, etc.

The spring actuated plunger 42 of the push to talk switch 40 biases the plunger actuating member 44 of the push to talk switch button 10 against the post **37*a* as shown in FIG. 3. To prevent any rattling of the push to talk switch button 18 in the microphone housing 10, the additional spring 48 is provided between the spring boss 46 and the post 50*a* to also bias the plunger actuating member 44 of the push to talk switch button 18 against the post 37*a* as shown in FIG. 3. As shown in FIGS. 2 and 3, the interlocking fingers 54–58 and the indentations 64 and 66 of the extension member 52 of the push to talk switch 18 are not engaged and interlocked with the alternating teeth 68, 72, 76 and 80 and the alternating spaces 70, 74, and 78 of the channel selector knob 22**.

When the two-way radio communications equipment is activated in the transmit mode of operation by depressing the push to talk switch button 18 of the microphone 10 with the operator's thumb 84, the push to talk switch button 18 pivots towards the inside of the microphone housing 10, the plunger actuating member 44 depresses the spring return plunger 42 into the normally open switch 40 thereby completing the push to talk transmit circuit of the two-way radio communications equipment, the spring 48 is depressed between the spring boss 46 and against the outside of the screw post 50*a*, and more importantly, the interlocking fingers 54, 56 and 58 on the extension member 52 of the push to talk switch button 18 engage and interlock with the alternating teeth 68, 72, 76 and 80 and the alternating spaces 70, 74 and 78 of the channel selector switch knob 22. The indentations 64 and 66 on the extension member 52 of the push to talk switch button 18 engage and interlock with the alternating teeth 72 and 76 respectively of the channel selector switch knob 22, while the alternating spaces 70, 74 and 78 on the channel selector switch knob 22 engage and interlock with the fingers 54, 56 and 58. This interlocking engagement of the fingers 54–60 with the spaces 70, 74, and 78 and the teeth 72 and 76 with the indentations 64 and 66 upon depressing the push to talk switch button 18 into the microphone housing 10 prevents the rotation of the channel selector knob 22, thereby preventing the changing of channels during the transmit mode of operation.

While the three interlocking fingers 54, 56 and 58 with the two alternating indentations 64 and 66 on the extension member 52 of the push to talk switch button 18 have been disclosed as providing the utmost stability and strength in the interlocking engagement between the push to talk switch button 18 and the channel selector switch knob 22, the invention can also be construed as utilizing only one, two, three, etc. of the interlocking fingers to achieve interlocking engagement between the push to talk switch button 18 and the channel selector switch knob 22.

The channel selector switch knob 22 can have any predetermined plurality of alternating teeth and spaces equally disposed about the circumference of the round circular knob corresponding an equal plurality of detents in the rotary channel switch and an equal plurality of channels of operation.

Various modifications can be made to the microphone of the present invention without departing from the apparent scope of the invention.

Having thus described the invention, what is claimed is:

1. A microphone for use with two-way radio communications equipment having a push to talk function to activate equipment into the transmit mode of operation, said microphone comprising:

a. hollow housing means;

b. grill means positioned in an upper portion of said housing means and a microphone means positioned adjacent said grill means internal to said housing means;

c. spring actuated push to talk switch button means pivotally mounted in said housing means and having a portion extending through a slot in said housing means;

d. push to talk spring actuated plunger switch positioned internal to said housing means and having the plunger engaging against a portion of said push to talk switch button means;

e. channel selector means rotatably mounted in said housing means and having a portion extending through a slot is said housing means; and, f. interlocking means operably engagable between said push to talk switch button means and channel selector means whereby when an operator depresses said push to talk switch button means into said housing means, said interlocking means lockably engages during transit mode of operation when said push to talk switch button means is depressed thereby preventing the switching of the channels during the transmit mode of operation.

2. The microphone of claim 1 further comprising a light emitting diode readout display positioned in said housing means where the channel of operation is visually displayed.

3. The microphone of claim 1 further comprising two opposing slots in said housing means and said channel selector means having a portion extending through each of said opposing slots of said housing means.

4. The microphone of claim 1 further comprising a spring boss affixed to said push to talk switch button means and extending inwardly to said housing means, a post vertically positioned internal to said housing means and a spring compressed between said post and accepted by said spring boss means whereby said spring biases said push to talk switch button means against said housing means to prevent vibration of said switch button means.

5. The microphone of claim 1 further comprising pivot post means at a lower end of said push to talk switch button means and a receiving hole means in said housing means whereby said push to talk switch button means pivots in said housing means.

6. The microphone of claim 1 wherein said channel selector means comprises a round circular knob and a plurality of alternating teeth and spaces equally spaced about the circumference of said channel selector means, and wherein said interlocking means comprises an interlocking finger affixed to said push to talk switch button means and extending inwardly of said push to talk switch button means lockably engages said interlocking finger into one of said spaces and between said teeth of said channel selector means thereby preventing movement of said channel selector means and preventing the switching of channels during the transmit mode of operation.

7. The microphone of claim 1 wherein said channel selector means comprises a circular knob and a plurality of alternating teeth and spaces equally disposed about the circumference of said channel selector means, and wherein said interlocking means comprises two interlocking fingers and one indentation in between said interlocking fingers affixed to said push to talk switch button means and extending inwardly of said housing means, whereby depressing said push to talk switch button means lockably engages said interlocking fingers into two spaces and between said teeth of said channel selector means, thereby preventing movement of said channel selector means and preventing the switching of channels during the transmit mode of operation.

8. The microphone of claim 1 wherein said channel selector means comprises a circular knob and a plurality of alternating teeth and spaces equally disposed about the circumference of said channel selector means, and wherein said interlocking means comprises three interlocking fingers and two indentations in between said three interlocking fingers, said interlocking fingers affixed to said push to talk switch button means and extending inwardly of said housing means, whereby depressing said push to talk switch button means lockably engages said interlocking fingers into three spaces and between said teeth of said channel selector means, thereby preventing movement of said channel selector means and preventing the switching of channels during the transmit mode of operation.

9. The microphone of claim 8 wherein said plurality of alternating teeth and spaces of said channel selector means corresponds to an equal plurality of channels of operation.

10. The microphone of claim 9 wherein said plurality of alternating teeth and spaces equally disposed about the circumference of said channel selector means comprises forty teeth and forty spaces alternating with said forty teeth corresponding to forty channels of the Citizens Radio Service as designated by the Federal Communications Commission.

* * * * *